US007432408B2

(12) United States Patent
Timken et al.

(10) Patent No.: US 7,432,408 B2
(45) Date of Patent: Oct. 7, 2008

(54) INTEGRATED ALKYLATION PROCESS USING IONIC LIQUID CATALYSTS

(75) Inventors: Hye Kyung C. Timken, Albany, CA (US); Saleh Elomari, Fairfield, CA (US); Steve Trumbull, San Leandro, CA (US); Robert Cleverdon, Walnut Creek, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 134 days.

(21) Appl. No.: 11/021,167

(22) Filed: Dec. 21, 2004

(65) Prior Publication Data

US 2006/0131209 A1 Jun. 22, 2006

(51) Int. Cl.
*C07C 2/56* (2006.01)
*C10L 1/06* (2006.01)

(52) U.S. Cl. ..... 585/709; 585/721; 208/16; 208/17

(58) Field of Classification Search ..... 585/709, 585/721; 208/16
See application file for complete search history.

(56) References Cited

U.S. PATENT DOCUMENTS

| | | | |
|---|---|---|---|
| 4,764,440 | A | 8/1988 | Jones et al. |
| 5,510,561 | A | 4/1996 | Sherman et al. |
| 5,593,569 | A | 1/1997 | Sherman |
| 5,654,251 | A | 8/1997 | Abbott et al. |
| 5,693,585 | A | 12/1997 | Benazzi et al. |
| 5,731,101 | A | 3/1998 | Sherif et al. |
| 5,750,455 | A | 5/1998 | Chauvin et al. |
| 5,824,832 | A | 10/1998 | Sherif et al. |
| 5,827,602 | A | 10/1998 | Koch et al. |
| 6,028,024 | A | 2/2000 | Hirschauer et al. |
| 6,235,959 | B1 | 5/2001 | Hirschauer et al. |
| 6,288,281 | B1 | 9/2001 | Nemeth et al. |
| 6,797,853 | B2 | 9/2004 | Houzvicka et al. |
| 2003/0060359 | A1 | 3/2003 | Olivier-Bourbigou et al. |
| 2004/0077914 | A1 | 4/2004 | Zavilla et al. |
| 2004/0133056 | A1 | 7/2004 | Liu et al. |

OTHER PUBLICATIONS

Gale, et al. Potentiometric Investigation of Dialuminum Heptachloride Formation in Aluminum Chloride-1-Butylpyridinium Choloride Mixtures, National Technical Information Service, Oct. 18, 1978, 1603-1605, Contribution from the Department of Chemistry, Colorado State University, Fort Collins, Colorado 80523 USA.

Gilbert, et al. Raman Spectra of Molten Aluminum Chloride: 1-Butylpyridinium Chloride Systems at Ambient Temperatures; Inorganic Chemistry, vol. 17, No. 10, 1978, pp. 2728-2729; contribution from the Department of Chemistry, Colorado State University, Fort Collins, Colorado 80523 USA.

(Continued)

*Primary Examiner*—Ellen M. McAvoy
(74) *Attorney, Agent, or Firm*—Susan M. Abernathy; Steven H. Roth

(57) ABSTRACT

An integrated refining process for the production of high quality gasoline blending components from low value components is disclosed. In addition there is disclosed a method of improving the operating efficiency of a refinery by reducing fuel gas production and simultaneously producing high quality gasoline blending components of low volatility. The processes involve the alkylation of a refinery stream containing pentane with ethylene using an ionic liquid catalyst.

32 Claims, 1 Drawing Sheet

Isopentane and Ethylene Alkylation Process Scheme

OTHER PUBLICATIONS

Robinson, et al. 1H and 13C Nuclear Magnetic Resonance Spectroscopy Studies of Aluminum Halide-Alkylpyridinium Halide Molten Salts and Their Benzene Solutions; Jul. 4, 1979, Journal of the American Chemical Sosciety 101:14 pp. 3776-3779. Contribution from the Department of Chemistry, Colorado State University, Fort Collins, Colorado USA.

Gale, et al. Infrared Spectral Investigations of Room-Temperature Aluminum Chloride-1-Butytpyridinium Chloride Melts; 1980 American Chemical Society, Oct. 19, 1979, pp. 2240-2242. Contribution from the Department of Chemistry, Colorado State University, Fort Collins Colorado USA.

Lipztajn, et al. On Ionic Association in Ambient Temperature Chloroaluminate Molten Salts. Analysis of Electrochemical and Conductance Data. J. Electrochem. Soc: Electrochemical Science and Technology May 1985 vol. 132, No. 5 pp. 1126-1130. Department of Chemistry, State University of New York at Buffalo, New York USA.

Bertlein, et al. Stabilisierung von Carbenium-Ionen durch Acide Salzschmelzen—eine NMR-Studie, Eingegangen am 2. Marz 1989. Chem. Ber. 122 (1989) 1661-1663. Institut fur Physikalische und Theoretische Chemie der Universitat Erlangen-Nurnberg, EgerlandstraBe 3, D-8520 Erlangen Germany.

Okoturo, et al. Temperature Dependence of Viscosity for Room Temperature Ionic Liquids. Journal of Electroanalytical Chemistry 568 (2004) 167-181 2004 Elsevier B.V. Chemistry Department, Queen Mary, University of London, Mile End Road, London E1 3NS, UK.

Yoo, et al. Ionic Liquid-Catalyzed Alkylation of Isobutane with 2-Butene. Journal of Catalysis 222 (2004) 511-519. 2004 Elsevier, Inc. Department of Chemical and Material Engineering, University of Cincinnati, Cincinnati, Ohio USA. Clean Processes Branch, National Risk Management Research Lab, US Environmental Protection Agency, MS 443, Cincinnati, Ohio USA.

Isopentane and Ethylene Alkylation Process Scheme

INTEGRATED ALKYLATION PROCESS USING IONIC LIQUID CATALYSTS

FIELD OF THE INVENTION

The present invention relates to an integrated refining process for the production of high quality gasoline blending components from low value components.

BACKGROUND OF THE INVENTION

Modern refineries employ many upgrading units such as fluidic catalytic cracking (FCC), hydrocracking (HCR), alkylation, and paraffin isomerization. As a result, these refineries produce a significant amount of isopentane. Historically, isopentane was a desirable blending component for gasoline having a high octane (92 RON), although it exhibited high volatility (20.4 Reid vapor pressure (RVP)). As environmental laws began to place more stringent restrictions on gasoline volatility, the use of isopentane in gasoline was limited because of its high volatility. As a consequence, the problem of finding uses for by-product isopentane became serious, especially during the hot summer season. Moreover, as more gasoline compositions contain ethanol instead of MTBE as their oxygenate component, more isopentane must be kept out of the gasoline pool in order to meet the gasoline volatility specification. So, the gasoline volatility issue becomes even more serious, further limiting the usefulness of isopentane as a gasoline blending component.

The process of the present invention solves this problem by converting undesirable isopentane to low-RVP gasoline blending components by alkylation of the isopentane with a refinery stream containing ethylene using an ionic liquid catalyst. Other olefins, such as propylene, butylenes, and pentenes can also be used to convert isopentane to make low RVP hydrocarbon product. By reducing the excess isopentane, the burden of storing isopentane and/or concerns for isopentane usage are eliminated.

In general, conversion of light paraffins and light olefins to more valuable cuts is very lucrative to the refining industries. This has been accomplished by alkylation of paraffins with olefins, and by polymerization of olefins. One of the most widely used processes in this field is the alkylation of isobutane with $C_3$-$C_5$ olefins to make gasoline cuts with high octane number using sulfuric and hydrofluoric acids. This process has been used by refining industries since the 1940's. The process was driven by the increasing demand for high quality and clean burning high octane gasoline.

Commercial paraffin alkylation processes in modern refineries use either sulfuric acid or hydrofluoric acid as catalyst. Both of these processes require extremely large amounts of acid to fill the reactor initially. The sulfuric acid plant also requires a huge amount of daily withdrawal of spent acid for off-site regeneration. Then the spent sulfuric acid is incinerated to recover $SO_2/SO_3$ and fresh acid is prepared. The necessity of having to handle a large volume of used acid is considered a disadvantage of the sulfuric acid based processes. On the other hand, an HF alkylation plant has on-site regeneration capability and daily make-up of HF is orders of magnitude less. However, the aerosol formation tendency of HF presents a potentially significant environmental risk and makes the HF alkylation process less safe than the $H_2SO_4$ alkylation process. Modern HF processes often require additional safety measures such as water spray and catalyst additive for aerosol reduction to minimize the potential hazards.

Although these catalysts have been successfully used to economically produce the best quality alkylates, the need for safer and environmentally-more friendly catalyst systems has become an issue to the industries involved. The ionic liquid catalyst of the present invention fulfills that need.

In addition, implementing the present invention relieves a refinery of the problem and waste associated with excess fuel gas production. It does this by using ethylene in, for example, offgas from a FCC unit as the source of olefins for the alkylation of isopentane. Typically FCC offgas contains ethylene up to 20 vol %. Other olefin streams containing ethylene or other olefins such as coker gas could also be used for this process. The overall gasoline volume is increased by this process of invention. The net amount of fuel gas from the FCC de-ethanizer is reduced, thus lowering the burden of fuel gas processing equipment. A further benefit of the present invention is that extracting ethylene will improve the purity of hydrogen in FCC offgas. The improved concentration of hydrogen in the offgas may allow the economical recovery of pure hydrogen with the use of a hydrogen recovery unit, such as a pressure-swing adsorption (PSA) unit or a selective hydrogen-permeable membrane unit. Considering tight environmental regulations associated with fuel gas production and shortage of hydrogen in modern refineries, the benefits of fuel gas reduction and hydrogen production are highly desirable.

The most economical, thus most desirable, olefin streams are FCC de-ethanizer overhead containing hydrogen, methane, ethane, and ethylene, or coker gas containing olefins. The present process converts the isopentane stream to a low RVP dimethyl pentane and trimethyl butane gasoline fraction with little octane loss. By employing the process of the invention, the overall gasoline volume produced at a refinery is increased. In addition, the net amount of fuel gas from the FCC de-ethanizer is reduced, thus lowering the burden on the fuel gas processing equipment.

Furthermore, the present invention includes a new paraffin alkylation process which can produce alkylate gasoline, the most desirable blending component in gasoline, in an environmentally sound manner far superior to the conventional alkylation process. In comparison with the conventional processes, the process according to the present invention offers the following significant advantages over conventional alkylation:

- Substantial reduction in capital expenditure as compared to sulfuric acid and hydrofluoric acid alkylation plants
- Substantial reduction in operating expenditure as compared to sulfuric acid alkylation plants
- Substantial reduction in catalyst inventory volume (potentially by 90%)
- A substantially reduced catalyst make-up rate (potentially by 98% compared to sulfuric acid plants)
- A higher gasoline yield
- Comparable or better product quality (Octane number, RVP, T50)
- Significant environment, health and safety advantages
- Expansion of alkylation feeds to include isopentane and ethylene.

It follows that employing a process according to the present invention a refiner can upgrade both isopentane and ethylene and at the same time react conventional alkylation feed components (e.g., butene, propylene, pentene, and isobutane) to produce high quality gasoline blending components. These additional capabilities are made possible in part with the high activity and selectivity of the ionic liquid catalyst used for these reactions. The present invention provides its greatest benefits when all these alkylation reactions are conducted with ionic liquid catalysts and none are conducted using sulfuric acid or hydrofluoric acid catalysts.

SUMMARY OF THE INVENTION

The present invention provides an integrated refinery process for the production of high quality gasoline blending components having low volatility comprising:

(a) providing a first ethylene-containing refinery stream;

(b) separating a $C_{2+}$ fraction from said first stream to produce a second refinery stream richer in ethylene than said first stream;

(c) providing an isopentane-containing refinery stream;

(d) contacting said isopentane-containing refinery stream with said second refinery stream in the presence of an ionic liquid catalyst in an alkylation zone under alkylation conditions; and (e) recovering high quality gasoline blending components of low volatility from said alkylation zone.

In addition the present invention provides a method of improving the operating efficiency of a refinery by reducing fuel gas production and simultaneously producing high quality gasoline blending components of low volatility.

The present invention also provides a high quality gasoline blending composition having low volatility prepared by the process described.

DETAILED DESCRIPTION

Feedstocks

Figure 1:
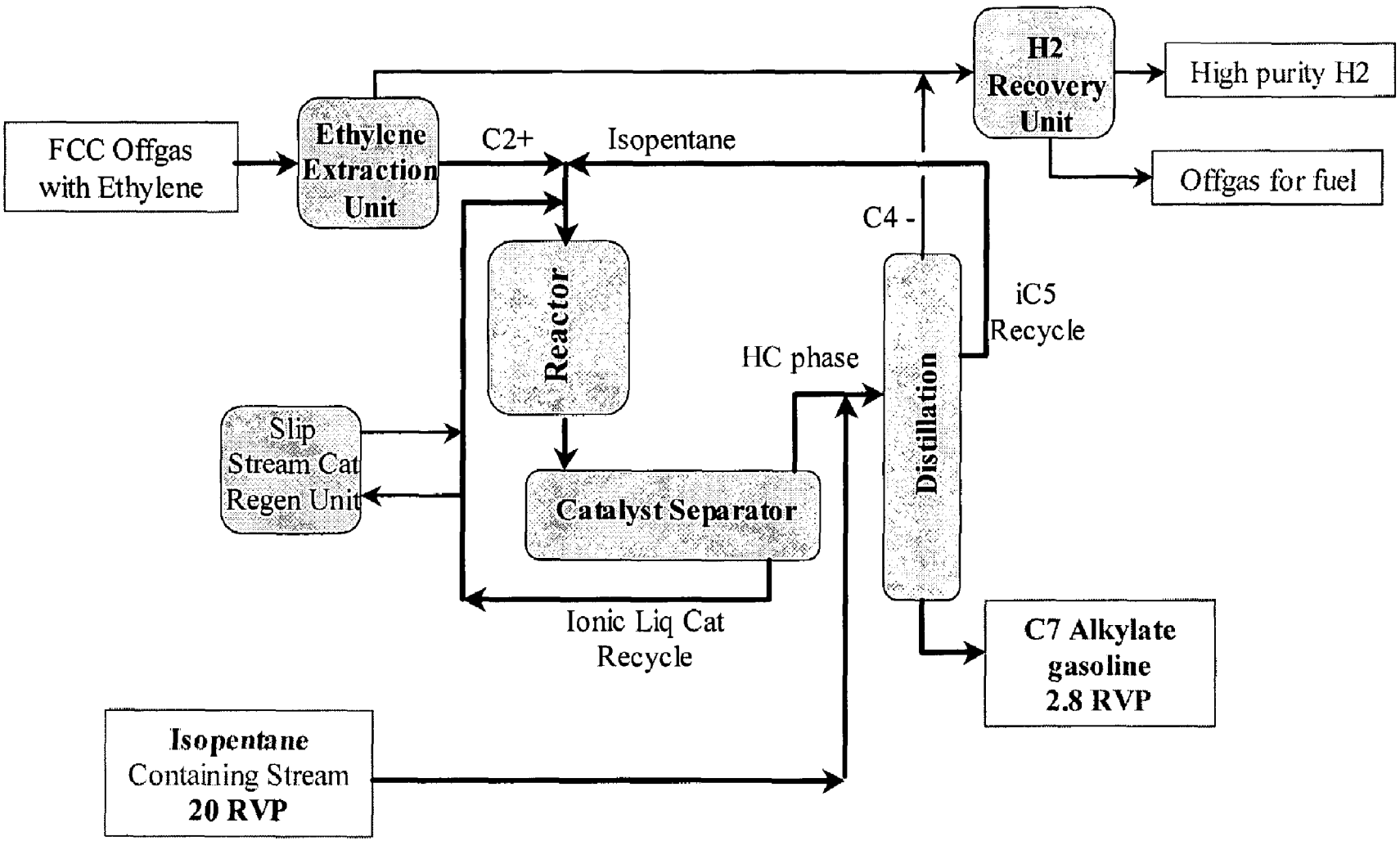
FIG. 1 is a diagram of for an integrated refinery process according to the present invention.

One of the feedstocks to the process of the present invention is a refinery stream which contains olefins. Examples of such streams include FCC offgas, coker gas, olefin metathesis unit offgas, polyolefin gasoline unit offgas, methanol to olefin unit offgas and methyl-t-butyl ether unit offgas. The preferred olefin is ethylene. The preferred source of ethylene for conducting a process according to the present invention is offgas from an FCC unit, which may contain up to about 20 vol % of ethylene. This stream may also contain propylene, butylenes and pentenes. The FCC offgas is preferably passed through an ethylene extraction unit to produce a $C_{2+}$ fraction, which is rich in ethylene, typically about 50 vol %, and a lighter fraction, which is rich in hydrogen. The $C_{2+}$ fraction is fed to the alkylation reactor.

Another feedstock to the process of the present invention is a refinery stream which contains isoparaffins, preferably isopentane. Refinery streams which contain isopentane and which may be used in the process of the present invention include, but are not limited to extracted isopentane from an FCC unit, a hydrocracking unit, $C_5$ and $C_6$ streams from crude unit distillation, and extracted $C_5$ and $C_6$ streams from a reformer. Analysis of an extracted pentane sample from one refinery showed the feed stock to contain 86.4% iso-pentane, 8% n-pentane, 0.9% n-butane, 3.4% $C_6$s-$C_9$s and 0.2% olefins ($C_4$ and $C_5$ olefins). It also contained 88 ppm sulfur (mercaptans) and 0.4 ppm nitrogen. The feed stream exhibited very high RVP of 20, while the desirable current RVP target for gasoline is 7 to 8 range.

The isopentane-containing stream may also contain other isoparaffins such as isobutane. Isobutane may be obtained, for example, from hydrocracking units or may be purchased.

Catalyst

The use of ionic liquids as a new media and solvents for chemical reactions and particularly catalytic processes has gained wide popularity in the past several years. There has been an overwhelming surge in this research arena where ionic liquids have been used as solvents in an array of reactions such as olefins dimerization, olefin oligomerization and polymerization, isomerizations, alkylations, hydrogenations, Diels-Alder cyclizations and many others. In short, ionic liquids have been used as solvents in a wide range of organic reactions and processes.

A large number of liquid or solid acid catalysts are known which are capable of effecting alkylation of isoparaffins such as isobutane or isopentane by olefins such as propylene, 1-butene, 2-butene and isobutylene. The catalysts which are most widely used in industrial practice are concentrated sulfuric acid and hydrofluoric acid alone or mixed with Lewis acids such as boron trifluoride.

Those processes suffer from major disadvantages: hydrofluoric acid by virtue of its toxicity and its high degree of volatility; and sulfuric acid by virtue of a substantial volumetric consumption of the catalyst requiring burdensome regeneration. These reasons have motivated the development of catalysts which are solid or which are supported on solids such as aluminosilicates or metal oxides such as zirconia treated with sulfuric acid. However, solid catalysts are generally found to present a low level of selectivity and a low degree of activity. The use of aluminum chloride has also been studied and proposed.

The process according to the present invention preferably employs a catalytic composition comprising at least one aluminum halide and at least one quaternary ammonium halide and/or at least one amine halohydrate. The aluminum halide which can be used in accordance with the invention is most preferably aluminum chloride.

The quaternary ammonium halides which can be used in accordance with the invention are those described in U.S. Pat. No. 5,750,455, which is incorporated by reference herein, which also teaches a method for the preparation of the catalyst.

The ionic liquid catalysts which are most preferred for the process of the present invention are N-butylpyridinium chloroaluminate ($C_5H_5NC_4H_9Al_2Cl_7$). A metal halide may be employed as a co-catalyst to modify the catalyst activity and selectivity. Commonly used halides for such purposes include NaCl, LiCl, KCl, $BeCl_2$, $CaCl_2$, $BaCl_2$, $SiCl_2$, $MgCl_2$, $PbCl_2$, CuCl, $ZrCl_4$, AgCl, and $PbCl_2$ as published by Roebuck and Evering (Ind. Eng. Chem. Prod. Res. Develop., Vol. 9, 77, 1970). Preferred metal halides are CuCl, AgCl, $PbCl_2$, LiCl, and $ZrCl_4$.

HCl or any Broensted acid may be employed as an effective co-catalyst. The use of such co-catalysts and ionic liquid catalysts that are useful in practicing the present invention is disclosed in U.S. Published Patent Application Nos. 2003/0060359 and 2004/0077914. Other co-catalysts that may be used to enhance the catalytic activity of ionic liquid catalyst system include IVB metal compounds preferably metal halides such as $TiCl_3$, $TiCl_4$, $TiBR_3$, $TiBR_4$, $ZrCl_4$, $ZrBr_4$, $HfCL_4$, $HfBr_4$, as described by Hirschauer et al. in U.S. Pat. No. 6,028,024.

It is especially important to note that $H_2SO_4$ and HF are not effective for the alkylation of isoparaffins with ethylene. So, the process of the present invention would not have been considered in the past.

Reaction Conditions

Due to the low solubility of hydrocarbons in ionic liquids, olefins-isoparaffins alkylation, like most reactions in ionic liquids is generally biphasic and takes place at the interface in the liquid state. The catalytic alkylation reaction is generally carried out in a liquid hydrocarbon phase, in a batch system, a semi-batch system or a continuous system using one reaction stage as is usual for aliphatic alkylation. The isoparaffin and olefin can be introduced separately or as a mixture. The molar ratio between the isoparaffin and the olefin is in the range 1 to 100, for example, advantageously in the range 2 to 50, preferably in the range 2 to 20. In a semi-batch system the isoparaffin is introduced first then the olefin, or a mixture of isoparaffin and olefin. Catalyst volume in the reactor is in the range of 2 vol % to 70 vol %, preferably in the range of 5 vol % to 50 vol %. Vigorous stirring is desirable to ensure good contact between the reactants and the catalyst. The reaction temperature can be in the range −40° C. to +150° C., preferably in the range −20° C. to +100° C. The pressure can be in the range from atmospheric pressure to 8000 kPa, preferably sufficient to keep the reactants in the liquid phase. Residence time of reactants in the vessel is in the range a few seconds to hours, preferably 0.5 min to 60 min. The heat generated by the reaction can be eliminated using any of the means known to the skilled person. At the reactor outlet, the hydrocarbon phase is separated from the ionic phase by decanting, then the hydrocarbons are separated by distillation and the starting isoparaffin which has not been converted is recycled to the reactor.

Typical reaction conditions may include a catalyst volume in the reactor of 5 vol % to 50 vol %, a temperature of −10° C. to 100° C., a pressure of 300 kPa to 2500 kPa, an isoparaffin to olefin molar ratio of 2 to 8 and a residence time of 1 min to 1 hour.

A catalyst system comprised of aluminum chloride and hydrogen chloride (hydrochloric acid) for catalyzing the alkylation of iso-paraffins and olefins in ionic liquids (chloroaluminate ionic liquids) is preferred. The HCl can be used as a co-catalyst to enhance the reaction rate. For example, the alkylation of isopentane with ethylene in a batch autoclave is complete in <10 minutes in the presence of HCl. In the absence of HCl, the reaction usually takes ½ hour to 1 hour time (50° C. and autogenic pressure of ~965 kPa and feed ratio of ~4). The product selectivity was comparable to that of chloroaluminate ionic liquid without the presence of HCl.

Process Configuration

A scheme for an integrated refinery alkylation process to implement an embodiment of the present invention is shown in FIG. 1.

An ethylene-containing refinery stream is fed to an Ethylene Extraction Unit to separate a $C_{2+}$fraction rich in ethylene. The Ethylene Extraction Unit is typically comprised of membrane and/or distillation column separation equipment. A second refinery stream containing isopentane is fed to a Distillation Zone. Streams enriched in ethylene and isopentane are contacted in the presence of an ionic liquid catalyst in a Reactor under alkylation conditions. Then the catalyst and hydrocarbon phases are separated in a Catalyst Separator and the catalyst is recycled back to the Reactor. A portion of the recycling catalyst is sent to a Slip Stream Catalyst Regeneration unit. The hydrocarbon phase is sent to a Distillation Zone to recover unreacted isopentane for recycle, and the alkylate product is collected at the bottom. As needed, the alkylate product can be treated to remove any trace impurities.

The reject stream from the Ethylene Extraction Unit now has higher hydrogen purity. Further upgrading of the reject stream can be achieved by recovering pure hydrogen gas with use of a $H_2$ Recovery Unit if desirable. The $H_2$ Recovery Unit is typically comprised of a selective hydrogen-permeable membrane unit and/or pressure-swing adsorption (PSA) unit.

A process according to the present invention offers a refiner considerable flexibility with respect to being able to prepare gasoline blending components of varying composition by selecting both the source of olefins used for alkylation and the paraffin-containing feedstock. Alkylation reactions in accordance with the present invention may be conducted in one or more alkylation zone using the same or different ionic liquid catalysts. For example, the $C_{2+}$fraction described above may contain propylene, butylene and/or pentenes and the isopentane containing stream may also contain isobutane. Isobutane may be alkylated with ethylene to produce a high-octane $C_6$ gasoline blending component. A $C_4$ olefin containing stream may be isolated and used for the alkylation of isobutane, isopentane or their mixtures. Other variations and combinations will be apparent to refiners generally.

The following examples are illustrative of the present invention, but are not intended to limit the invention in any way beyond what is contained in the claims which follow.

EXAMPLES

Example 1

The Preparation of N-Butyl-Pyridinium Chloroaluminate Ionic Liquid

N-butyl-pyridinium chloroaluminate is a room temperature ionic liquid prepared by mixing neat N-butyl-pyridinium chloride (a solid) with neat solid aluminum trichloride in an inert atmosphere. The syntheses of butylpyridinium chloride and the corresponding N-butyl-pyridinium chloroaluminate are described below. In a 2-L Teflon-lined autoclave, 400 gm (5.05 mol.) anhydrous pyridine (99.9% pure purchased from Aldrich) were mixed with 650 gm (7 mol.) 1-chlorobutane (99.5% pure purchased from Aldrich). The neat mixture was sealed and let to stir at 145° C. under autogenic pressure over night. Then, the autoclave was cooled down to room temperature, vented and the resultant mixture was transferred to a three liter round bottom flask. Chloroform was used to rinse the liner and dissolve the stubborn crusty product that adhered to the sides of the liner. Once all transferred, the mixture was concentrated at reduced pressure on a rotary evaporator (in a hot water bath) to remove excess chloride, un-reacted pyridine and the chloroform rinse. The obtained tan solid product was further purified by dissolving in hot acetone and precipitating the pure product through cooling and addition of diethyl ether. Filtering and drying under vacuum and heat on a rotary evaporator gave 750 gm (88% yields) of the desired product as an off-white shinny solid. 1H-NMR and 13C-NMR were ideal for the desired N-butyl-pyridinium chloride and no presence of impurities was observed by NMR analysis. N-butylpyridinium chloroaluminate was prepared by slowly mixing dried N-butylpyridinium chloride and anhydrous aluminum chloride ($AlCl_3$) according to the following procedure. The N-butylpyridinium chloride (prepared as described above) was dried under vacuum at 80° C. for 48 hours to get rid of residual water (N-butylpyridinium chloride is hydroscopic and readily absorbs water from exposure to air). Five hundred grams (2.91 mol.) of the dried N-butylpyridinium chloride were transferred to a 2-Liter beaker in a nitrogen atmosphere in a glove box. Then, 777.4 gm (5.83 mol.) of anhydrous powdered $AlCl_3$ (99.99% from Aldrich) were added in small portions (while stirring) to control the temperature of the highly exothermic reaction. Once all the $AlCl_3$ was added, the resulting amber-looking liquid was left to gently stir overnight in the glove box. The liquid was then filtered to remove any un-dissolved $AlCl_3$. The resulting acidic N-butyl-pyridinium chloroaluminate was used as the catalyst for the alkylation of isopentane with ethylene.

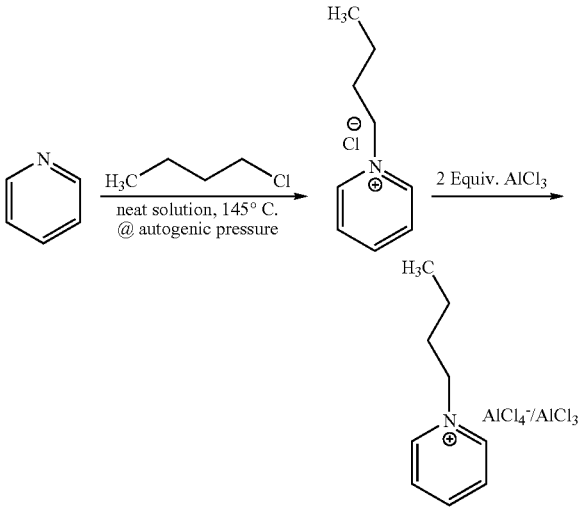

Example 2

Batch Alkylation Run Procedure

Isopentane and ethylene batch alkylation was typically run at 50° C. with paraffin/olefin molar ratio of about 4. Under nitrogen atmosphere in a glove box, an autoclave vessel was charged with ionic liquid catalyst and anhydrous isopentane. The autoclave was then sealed and transferred to a hood and affixed to an overhead stirrer. Then, ethylene gas was introduced to the vessel. The autogenic pressure of the vessel usually rises to 2000 kPa to 24000 kPa depending on the amount of ethylene gas introduced into the autoclave. Once the reaction begins stirring (~1200 rpm), the pressure quickly drops down to ~900 kPa to 1100 kPa. The reaction is allowed to continue and stir until the pressure drops to 0 kPa to 70 kPa. Then, the stirring is stopped and the heating mantle is quickly removed. The autoclave is then cooled down to room temperature using a cooling coil. Then, a gas sample was drawn and the reactor is vented and weathered to relieve the system from any remaining gas. The resulting solution is a biphasic with the product and excess isopentane phase is on top while the dense ionic liquid-catalyst phase is on the bottom. The top phase is then decanted and saved for analysis. The bottom phase is either recycled for further use or neutralized with water. Chemical analysis of the products in excess isopentane is usually done by gas chromatography analysis.

Example 3

Batch Alkylation of Isopentane in Butylpyridinium Chloroaluminate without Applying Any Additional Pressure (Only the Autogenic Pressure of the System)

Ethylene (9.5 gm) was alkylated with isopentane (103 gm) in 20 gm butylpyridinium chloroaluminate ionic at 50° C. and the autogenic pressure in a closed 300 cc autoclave fitted with an overhead stirrer and a cooling coil. The reaction was allowed to stir at ~1200 rpm until no significant drop in pressure was noticeable. Table 1 below shows the reaction results.

Example 4

Batch Alkylation of Isopentane in Butylpyridinium Chloroaluminate at Autogenic Pressure in the Presence of HCl as a Co-Catalyst The reaction above was repeated in a fresh ionic liquid (19.6 gm) but this time HCl (0.35 gm) was added as a co-catalyst (promoter) with 102.7 gm isopentane and 9.7 gm ethylene. The reaction was run at 50° C. and autogenic pressure and 1200 rpm stirring. The reaction was terminated when no further pressure drop was noticeable. With HCl the reaction was noticeably exothermic. Table 1 below shows the results of the reaction.

TABLE 1

Batch Alkylation of Isopentane and Ethylene with ButylPyridinium Chloroaluminate Catalyst

| Reaction | Example 3 Without HCl | Example 4 With HCl |
|---|---|---|
| $iC5/C_2$ = | 4 | 4 |
| Temp. (° C.) | 50 | 50 |
| Starting pressure, kPa | 2050 | 2080 |
| Ending Pressure, kPa | 76 | 48 |
| Reaction Time (min.) | 44 | 5 |
| Yields % | | |
| $C_{3-}$ | 0 | 0 |
| $C_4$ | 3.6 | 4.1 |
| $C_6$ | 4.1 | 8.0 |
| $C_7$ | 70.5 | 63.3 |
| $C_8$ | 8.9 | 9.1 |
| $C_9$ | 6.2 | 7.1 |
| $C_{10}$ | 3.5 | 4.2 |
| $C_{11+}$ | 3.4 | 4.3 |

The results from isopentane/ethylene alkylation are excellent and most of the products are in the desired alkylates range where $C_7$s constitute the major fraction of the product mixture. Very little heavy products were produced.

Example 4 shows that addition of HCl as a co-catalyst enhances the activity of the ionic liquid catalyst and changes the product selectivity. When HCl was added as a co-catalyst, the reaction was done at much shorter time (completed in 5 minutes) and slight change in product selectivity was observed.

Example 5

Batch Alkylation of Isopentane and Ethylene with Other Chloroaluminate Ionic Liquid Catalyst Other chloroaluminate ionic liquid catalysts with quaternary ammonium or amine halide salt can perform the same alkylation chemistry. Table 2 below compares the alkylation results of isopentane with ethylene in different chloroaluminate ionic liquid catalysts. Quaternary ammonium or amine salts used are 1 -butyl-pyridinium (BPy), 4-methyl-1-butyl-pyridinium (MBPy), 1-butyl-4-methyl-imidaazolium (BMIM) and tributyl-methyl-ammonium (TBMA) chloroaluminates. The reactions were all conducted at 50° C. and autogenic pressure at a feed paraffin/olefin molar ratio of 4, in 20 gm ionic liquid for 1 hour.

TABLE 2

Batch Alkylation of Isopentane and

Ethylene with Various Chloroaluminate Catalyst

| | Salt used to make the chloroaluminate catalyst | | | |
|---|---|---|---|---|
| | MBPy | BPy | TBMA | BMIM |
| Starting Pressure, kPa | 2040 | 2230 | 2140 | 1920 |
| Ending Pressure, kPa | 290 | 76 | 540 | 69 |
| Ethylene Conversion | 65% | 95% | 55% | 95% |
| Product Selectivity, wt % | | | | |
| $C_{3-}$ | 2.6 | 0 | 3.0 | 0 |
| $C_4$ | 3.3 | 3.6 | 2.4 | 3.6 |
| $C_6$ | 3.8 | 4.3 | 2.7 | 4.2 |
| $C_7$ | 65.8 | 65.6 | 69.1 | 68.8 |
| $C_8$ | 9.9 | 9.8 | 9.2 | 9.7 |
| $C_9$ | 7.3 | 6.5 | 7.3 | 6.4 |
| $C_{10}$ | 5.5 | 4.7 | 4.3 | 4.3 |
| $C_{11+}$ | 1.6 | 3.4 | 1.9 | 3.0 |

The results above indicate that conversion of ethylene and product selectivity are affected by the catalyst selection. A chloroaluminate catalyst made with tributyl-methyl-ammonium is less active than the other three catalysts. Chloroaluminate catalysts made with hydrocarbyl substituted pyridinium chloride or a hydrocarbyl substituted imidazolium chloride shows high activity and good selectivity.

Example 6

Continuous Alkylation of Isopentane with Ethylene

Evaluation of ethylene alkylation with isopentane was performed in a 100 cc continuously stirred tank reactor. 4:1 molar ratio of isopentane and ethylene mixture was fed to the reactor while vigorously stirring at 1600 rpm. An Ionic liquid catalyst was fed to the reactor via a second inlet port targeting to occupy 15 vol % in the reactor. A small amount of anhydrous HCl gas was added to the process (10:1 molar ratio of catalyst to HCl). The average residence time for the combined volume of feeds and catalyst was about 40 minutes. The outlet pressure was maintained at 2300 kPa using a backpressure regulator. The reactor temperature was maintained at 50° C. The reactor effluent was separated in a 3-phase separator into $C_{4-}$ gas; alkylate hydrocarbon phase, and the ionic liquid catalyst. Operating conditions and yield information are summarized in Table 3.

TABLE 3

Continuous Alkylation of Isopentane and Ethylene

| | |
|---|---|
| Temperature, ° C. | 50 |
| Total Pressure, kPa | 2300 |
| Catalyst Volume Fraction | 0.15 |
| External I/O Ratio, molar | 4.0 |
| Olefin Space Velocity/Vol. of Cat (LHSV) | 1.1 |
| Catalyst to HCl Ratio, molar | 10 |
| Residence Time of Reactant, min | 40 |
| Conversion of Ethylene, wt % | 95 |
| Selectivity of Converted Products, wt % | |
| $C_{4-}$ | 4.3 |
| n $C_5$ + neo $C_5$ | 2.1 |
| $C_6$ | 4.2 |
| $C_7$ | 78.6 |
| $C_8$ | 1.4 |
| $C_9$ | 7.0 |
| $C_{10+}$ | 2.4 |
| Total | 100.0 |
| $C_7$ Product Isomer Distribution, % | |

TABLE 3-continued

Continuous Alkylation of Isopentane and Ethylene

| | |
|---|---|
| Trimethylbutane/total $C_7$ | 0.2 |
| 2,3-Dimethylpentane/total $C_7$ | 49.0 |
| 2,4-Dimethylpentane/total $C_7$ | 48.6 |
| Other-Dimethylpentane/total $C_7$ | 0.1 |
| Methylhexane/total $C_7$ | 2.1 |
| n-heptane/total $C_7$ | 0.0 |
| Sum | 100.0 |

This alkylation process is highly selective in that 78.6% of the converted product is $C_7$ isoparaffins. Detailed compositional analysis of the alkylate gasoline indicates the $C_7$ fraction is nearly entirely derived from 2,3- and 2,4-dimethylpentane. 2,3-dimethylpentane and tri-methylbutanes are desirable isomers for high-octane gasoline (91 and 112 RON, respectively).

The hydrocarbon product was distilled to separate n-pentane and higher boiling alkylate gasoline (30° C.+) fraction and properties of the alkylate gasoline were measured or estimated. Research octane number was calculated based on GC composition and research octane number of pure compounds assuming volumetric linear blending. Blending octane numbers were measured at 7.5% and 15% blending level, then extrapolated to 100%. RVP and average density were estimated using the GC data assuming linear molar blending. T10, T50 and T90 were measured using ASTM D2887 simulated distillation.

TABLE 4

Product Properties of Alkylate Gasoline from Isopentane and Ethylene Alkylation

| | |
|---|---|
| Average density, g/cc | 0.69 |
| Average molecular weight, g/mole | 104 |
| Average RVP | 2.5 |
| Average RON | 87 |
| Blending RON | 91 |
| Blending MON | 84 |
| Simulated Distillation, D2887, ° C. | |
| T-10 wt % | 76 |
| T-50 wt % | 88 |
| T-90 wt % | 119 |

The product property data shows that by employing the process of the present invention, high RVP isopentane (20 RVP) was converted to alkylate gasoline having a low RVP of 2.5. The high-octane (91 blending RON) and excellent boiling point distribution are other desirable features of the gasoline blending components prepared in accordance with the present method. To achieve the high-octane, it is preferable to maintain the 2,3-dimethylpentane selectivity above 40% relative to the total $C_7$ yield.

Example 7

Continuous Alkylation of Isopentane with Propylene

Propylene alkylation with isopentane was performed via a similar procedure to that described in Example 6 except different process conditions were used. 8:1 molar ratio of isopentane and propylene mixture was fed to the reactor, at 10° C. reactor temperature and 7 vol % of catalyst. A summary of operating conditions and yield information are presented in Table 5.

TABLE 5

| Continuous Alkylation of Isopentane and Propylene | |
|---|---|
| Temperature, ° C. | 10 |
| Total Pressure, kPa | 290 |
| Catalyst Volume Fraction | 0.07 |
| External I/O Ratio, molar | 8.0 |
| Olefin Space Velocity/Vol. of Cat (LHSV) | 4.4 |
| Residence Time of Reactant, min | 24 |
| Conversion of Propylene, wt % | 100 |
| Selectivity of Converted Products, wt % | |
| $C_{4-}$ | 3.6 |
| $C_6$ | 2.3 |
| $C_7$ | 1.4 |
| $C_8$ | 74.2 |
| $C_9$ | 2.9 |
| $C_{10+}$ | 15.6 |
| Total | 100.0 |
| $C_8$ Product Isomer Distribution, wt % | |
| Trimethylpentane/total $C_8$ | 36.5 |
| Dimethylhexane/total $C_8$ | 54.8 |
| Methylheptane/total $C_8$ | 8.7 |
| n-octane/total $C_8$ | 0.0 |
| Sum | 100.0 |

The hydrocarbon product was distilled to generate n-pentane and higher boiling alkylate gasoline (30° C.+) fraction and properties of the alkylate gasoline were measured or estimated, and reported in Table 6.

TABLE 6

| Product Properties of Alkylate Gasoline from Isopentane and Propylene Alkylation | |
|---|---|
| Average density, g/cc | 0.71 |
| Average molecular weight, g/mole | 119 |
| Average RVP | 1.0 |
| Average RON | 82 |
| Blending RON | 79 |
| Blending MON | 78 |
| Simulated Distillation, D2887, deg C. | |
| T-10 wt % | 107 |
| T-50 wt % | 111 |
| T-90 wt % | 169 |

The product property data shows that employing a process according to the present invention high RVP isopentane (20 RVP) was converted to alkylate gasoline having a low RVP of 1.0. The high-octane (82 RON), and excellent boiling point distribution are other desirable features of gasoline blending components prepared in accordance with the present invention.

Example 8

Alkylation of Isobutane with 2-Butene

Evaluation of $C_4$ olefin alkylation with isobutane was performed in a 100 cc continuously stirred tank reactor. 8:1 molar ratio of isobutane and 2-butene mixture was fed to the reactor while vigorously stirring at 1600 RPM. An Ionic liquid catalyst was fed to the reactor via a second inlet port targeting to occupy 10-15 vol % in the reactor. A small amount of anhydrous HCl gas was added to the process. The average residence time (combined volume of feeds and catalyst) was about 8 minutes. The outlet pressure was maintained at 100 psig using a backpressure regulator. The reactor temperature was maintained at 0° C. using external cooling. The reactor effluent was separated in a 3-phase separator into $C_4^-$ gas, alkylate hydrocarbon phase, and the ionic liquid catalyst. Detailed composition of alkylate gasoline was analyzed using gas chromatography. Research Octane number was calculated based on GC composition and Research Octane number of pure compounds assuming volumetric linear blending. The operating conditions and performance are summarized in Table 7.

TABLE 1

| Paraffin Alkylation with C4 olefins | | |
|---|---|---|
| Feed Olefin Source | cis-2-butene | trans-2-butene |
| Feed Paraffin Source | isobutane | isobutane |
| Catalyst | BupyAl2Cl7 | CuCl/BupyAl2Cl7 |
| AlCl3 cat: HCl molar ratio | 60 | 40 |
| Acid volume fraction | 0.1 | 0.15 |
| RPM of reactor stirring | 1600 | 1600 |
| Temp | 0 | 0 |
| Olefin space velocity, LHSV | 6.6 | 4.3 |
| External I/O ratio, molar | 8.0 | 8.0 |
| Residence time of reactant, min | 8.0 | 8.1 |
| Olefin conversion, wt % | 100 | 100 |
| C5+ Gasoline Composition | | |
| C5 | 1.1 | 1.5 |
| C6 | 2.4 | 1.8 |
| C7 | 2.7 | 2.3 |
| C8 | 82.9 | 79.8 |
| C9+ | 10.9 | 14.6 |
| Sum | 100.0 | 100.0 |
| % tri-Me-pentane/total C8 | 95.3 | 95.3 |
| % Di-Me-hexane/total C8 | 4.5 | 4.5 |
| % Me-Heptane/total C8 | 0.2 | 0.2 |
| % n-Octane/total C8 | 0.0 | 0.0 |
| Research Octane | 98.6 | 98.4 |

The results in Table 7 show that high octane alkylate can be obtained with n-butylpyridinium chloroaluminate ionic liquid catalyst. With 2-butene, over 95% of the C8 fraction is composed of trimethylpentanes having a RON of about 100.

Example 9

Fuel Gas Reduction and $H_2$ Recovery Option

The process of the present invention can decrease the amount of excess fuel gas production in a refinery by converting ethylene in FCC offgas. This aspect of this invention is shown in this Example using a typical FCC offgas data from a refinery, as summarized in Table 8.

TABLE 8

| Fuel Gas Reduction and $H_2$ Recovery Option using Ethylene Alkylation | | | |
|---|---|---|---|
| | Typical FCC Offgas As-Is | After $C_{2+}$ Extraction | After $C_{2+}$ Extraction + $H_2$ Recovery |
| Offgas Volume, MMSCFD* | 26 | 21 | 12 |
| Reduction in Fuel Gas, % | 0 (Base case) | 19 | 55 |
| $H_2$ Recovered, MMSCFD | 0 | 0 | 9.2 |
| Offgas Composition, vol % | | | |
| $H_2S$ | 10 ppm | 0 | 0 |
| $N_2$ | 6.0 | 7.4 | 13.2 |
| $O_2$ | 0.1 | 0 | 0 |
| $CO_2$ | 0.4 | 0 | 0 |

TABLE 8-continued

| Fuel Gas Reduction and $H_2$ Recovery Option using Ethylene Alkylation | | | |
|---|---|---|---|
| | Typical FCC Offgas As-Is | After $C_{2+}$ Extraction | After $C_{2+}$ Extraction + $H_2$ Recovery |
| CO | 0.3 | 0 | 0 |
| $H_2$ | 35.8 | 44.0 | 0 |
| Methane | 27.5 | 33.8 | 60.4 |
| Ethane | 10.6 | 13 | 23.2 |
| Ethylene | 15 | 0 | 0 |
| Propane | 1.2 | 1.5 | 2.7 |
| Propylene | 2.5 | 0 | 0 |
| n-Butane | 0.1 | 0.1 | 0.2 |
| Isobutane | 0.1 | 0 | 0 |
| Butene | 0.1 | 0 | 0 |
| $C_{5+}$ | 0.3 | 0.2 | 0.4 |
| Sum | 100 | 100.0 | 100.0 |

This refinery generates 26 million standard cubic feet (MMSCFD) of fuel gas from an FCC unit daily and the stream contains 15 vol % ethylene. Using a process according to the present invention results in converting the ethylene stream into high-octane gasoline blending component by alkylating the stream with isopentane or isobutane. The amount of fuel gas from the ethylene extraction unit is reduced to 21 MMSCFM, thus lowering the burden of fuel gas processing equipment. In this case, approximately a 19 percent reduction of fuel gas is feasible.

Extracting ethylene or the $C_{2+}$ stream will improve the purity of hydrogen in FCC offgas as shown in Table 8, from 36% to 44%. Further upgrading of the reject stream can be achieved by recovering pure hydrogen gas with use of a hydrogen recovery unit such as a pressure-swing adsorption (PSA) unit or a membrane unit. By combining extraction of ethylene and hydrogen recovery, the amount of fuel gas is reduced substantially. In this case, up to a 55% reduction of fuel gas can be realized relative to the base case. In addition, 9 MMSCFD of hydrogen gas can be recovered. Considering the very stringent environmental regulations that are associated with fuel gas production and storage of hydrogen in refineries, the benefits of fuel gas reduction and hydrogen production that are made possible by using the present invention are significant and highly desirable.

There are numerous variations on the present invention which are possible in light of the teachings and supporting examples described herein. It is therefore understood that within the scope of the following claims, the invention may be practiced otherwise than as specifically described or exemplified herein.

What is claimed is:

1. An integrated refinery process for the production of high quality gasoline blending components having low volatility comprising:

(a) providing a first ethylene-containing refinery stream;

(b) separating a $C_{2+}$ fraction from said first stream to produce a second refinery stream richer in ethylene than said first stream;

(c) providing an isopentane-containing refinery stream;

(d) contacting said isopentane-containing refinery stream with said second refinery stream in the presence of an ionic liquid catalyst in the absence of a Group IV B metal compound in an alkylation zone under alkylation conditions for 0.5 to 60 minutes whereby an ethylene conversion of at least 65% is obtained; and (e) recovering high quality gasoline blending components of low volatility from said alkylation zone.

2. A process according to claim 1, wherein the ethylene-containing refinery stream comprises offgas from a FCC unit.

3. A process according to claim 1, wherein the ethylene-containing refinery stream comprises FCC de-ethanizer overhead.

4. A process according to claim 1, wherein the ionic liquid catalyst comprises a hydrocarbyl substituted pyridinium chloride or a hydrocarbyl substituted imidazolium chloride.

5. A process according to claim 4, wherein the ionic liquid catalyst comprises an alkyl substituted pyridinium chloride or an alkyl substituted imidazolium chloride.

6. A process according to claim 5, wherein the ionic liquid catalyst is selected from the group consisting of 1-butyl-4-methyl-pyridinium chloroaluminate (BMP), 1-butyl-pyridinium chloroaluminate (BP), 1-butyl-3-methyl-imidazolium chloroaluminate BMIM) and 1-H-pyridinium chloroaluminate (HP).

7. A process according to claim 1, further comprising blending the high quality gasoline blending components into gasoline.

8. A process according to claim 1, wherein the isopentane-containing stream comprises isopentane extracted from an FCC unit, isopentane extracted from a hydrocracking unit, $C_5$ and $C_6$ streams derived from distillation of crude oil, or $C_5$ and $C_6$ streams extracted from a reformer.

9. A process according to claim 1, wherein the ionic liquid catalyst further comprises an HCl co-catalyst.

10. A process according to claim 1, wherein the first ethylene-containing refinery stream comprises ethylene, propylene, butylenes and pentenes.

11. A process according to claim 1, wherein the first refinery stream contains hydrogen and further comprises separating a C2− fraction from the first refinery stream which is richer in hydrogen than said first stream; and recovering hydrogen from the C2− fraction.

12. A process according to claim 1, further comprising:

(f) providing a third refinery stream comprising at least one olefin selected from the group consisting of ethylene, propylene, butylenes, pentenes and mixtures thereof;

(g) providing a fourth refinery stream comprising at least one isoparaffin selected from the group consisting of isobutane, isopentane and mixtures thereof;

(h) contacting said third and fourth refinery streams with an ionic liquid catalyst in a second alkylation zone under alkylation conditions; and (i) recovering gasoline blending components from the second alkylation zone.

13. A method of improving the operating efficiency of a refinery by reducing fuel gas production and simultaneously producing high quality gasoline blending components of low volatility comprising:

(a) providing a first refinery stream comprising hydrogen and $C_2$-$C_5$ olefins;

(b) separating a $C_{2+}$ fraction from said first stream to produce a second refinery stream richer in olefins than said first stream and a third refinery stream richer in hydrogen than said first stream;

(c) providing an isopentane-containing refinery stream;

(d) contacting said isopentane-containing refinery stream with said second refinery stream in the presence of an ionic liquid catalyst in the absence of a Group IV B metal compound in an alkylation zone under alkylation conditions for 0.5 to 60 minutes whereby an ethylene conversion of at least 65% is obtained;

(e) recovering high quality gasoline blending components of low volatility from said alkylation zone; and (f) recovering hydrogen from said third refinery stream.

14. A method according to claim 13, wherein the ethylene-containing refinery stream comprises offgas from a FCC unit.

15. A method according to claim 13, wherein the ethylene-containing refinery stream comprises FCC de-ethanizer overhead.

16. A method according to claim 13, wherein the ionic liquid catalyst comprises a hydrocarbyl substituted pyridinium chloride or a hydrocarbyl substituted imidazolium chloride.

17. A process according to claim 16, wherein the ionic liquid catalyst comprises an alkyl substituted pyridinium chloride or an alkyl substituted imidazolium chloride.

18. A process according to claim 17, wherein the ionic liquid catalyst is selected from the group consisting of 1-butyl-4-methyl-pyridinium chloroaluminate (BMP), 1-butyl-pyridinium chloroaluminate (BP), 1-butyl-3-methyl-imidazolium chloroaluminate BMIM) and 1-H-pyridinium chioroaluminate (HP).

19. A method according to claim 13, further comprising blending the high quality gasoline blending components into gasoline.

20. A method according to claim 13, wherein the isopentane-containing stream comprises isopentane extracted from an FCC unit, isopentane extracted from a hydrocracking unit, $C_5$ and $C_6$ streams derived from distillation of crude oil, or $C_5$ and $C_6$ streams extracted from a reformer.

21. A method according to claim 13, wherein the ionic liquid catalyst further comprises an HCl co-catalyst.

22. A method according to claim 13, wherein the first ethylene-containing refinery stream comprises ethylene, propylene, butylenes and pentenes.

23. A method according to claim 13, further comprising:

(g) providing a third refinery stream comprising at least one olefin selected from the group consisting of ethylene, propylene, butylenes, pentenes and mixtures thereof;

(h) providing a fourth refinery stream comprising at least one isoparaffin selected from the group consisting of isobutane, isopentane and mixtures thereof;

(i) contacting said third and fourth refinery streams with an ionic liquid catalyst in a second alkylation zone under alkylation conditions; and (j) recovering gasoline blending components from the second alkylation zone.

24. A high quality gasoline blending composition having low volatility prepared by a process comprising:

(a) providing a first ethylene-containing refinery stream;

(b) separating a $C_{2+}$ fraction from said first stream to produce a second refinery stream richer in ethylene than said first stream;

(c) providing an isopentane-containing refinery stream;

(d) contacting said isopentane-containing refinery stream with said second refinery stream in the presence of an ionic liquid catalyst in the absence of a Group IV B metal compound in an alkylation zone under alkylation conditions for 0.5 to 60 minutes whereby an ethylene conversion of at least 65% is obtained; and (e) recovering high quality gasoline blending components of low volatility from said alkylation zone.

25. A composition according to claim 24, wherein the ethylene-containing refinery stream comprises offgas from a FCC unit.

26. A composition according to claim 24, wherein the ethylene-containing refinery stream comprises FCC de-ethanizer overhead.

27. A composition according to claim 24, wherein the ionic liquid catalyst comprises a hydrocarbyl substituted pyridinium chloride or a hydrocarbyl substituted imidazolium chloride.

28. A composition according to claim 27, wherein the ionic liquid catalyst comprises an alkyl substituted pyridinium chloride or an alkyl substituted imidazolium chloride.

29. A process according to claim 28, wherein the ionic liquid catalyst is selected from the group consisting of 1-butyl-4-methyl-pyridinium chloroaluminate (BMP), 1-butyl-pyridinium chloroaluminate (BP), 1-butyl-3-methyl-imidazolium chioroaluminate BMIM) and 1-H-pyridinium chioroaluminate (HP).

30. A composition according to claim 24, wherein the isopentane-containing stream comprises isopentane extracted from an FCC unit, isopentane extracted from a hydrocracking unit, $C_5$ and $C_6$ streams derived from distillation of crude oil, or $C_5$ and $C_6$ streams extracted from a reformer.

31. A composition according to claim 24, wherein the ionic liquid catalyst further comprises an HCl co-catalyst.

32. A composition according to claim 24, wherein the first ethylene-containing refinery stream comprises ethylene, propylene, butylenes and pentenes.

* * * * *